US005518586A

United States Patent [19]

Mirous

[11] Patent Number: 5,518,586

[45] Date of Patent: May 21, 1996

[54] METHOD OF MAKING A HIGH TEAR STRENGTH GLASS MAT

[75] Inventor: George E. Mirous, Tacoma, Wash.

[73] Assignee: Georgia-Pacific Resins, Inc., Atlanta, Ga.

[21] Appl. No.: 450,151

[22] Filed: May 26, 1995

Related U.S. Application Data

[62] Division of Ser. No. 123,094, Sep. 20, 1993, Pat. No. 5,445,878.

[51] Int. Cl.[6] ..... D04H 1/64

[52] U.S. Cl. ..... 162/156; 162/158; 162/167; 162/186; 156/62.2

[58] Field of Search ..... 162/156, 167, 162/158, 166, 186, 184; 156/62.2; 264/109

[56] References Cited

U.S. PATENT DOCUMENTS

| | | |
|---|---|---|
| 2,906,660 | 9/1959 | Hungerford et al. . |
| 3,012,929 | 12/1961 | Jackson . |
| 3,050,427 | 8/1962 | Slayter et al. . |
| 3,103,461 | 9/1963 | Smith et al. . |
| 3,228,825 | 1/1966 | Waggoner . |
| 3,760,458 | 9/1973 | Pitt . |
| 3,766,003 | 10/1973 | Schuller et al. . |
| 3,838,995 | 10/1974 | Smith . |
| 3,905,067 | 9/1975 | Keib et al. . |
| 4,178,203 | 12/1979 | Chakrabarti . |
| 4,210,462 | 7/1980 | McCombs . |
| 4,210,562 | 7/1980 | McCombs . |
| 4,258,098 | 3/1981 | Bondoc et al. . |
| 4,430,158 | 2/1984 | Jackey et al. . |
| 4,457,785 | 7/1984 | Hsu et al. . |
| 4,536,446 | 8/1985 | Hsu et al. . |
| 4,681,658 | 7/1987 | Hsu et al. . |
| 4,683,165 | 7/1987 | Linderman et al. . |
| 4,917,764 | 4/1990 | Lalwani et al. . |
| 5,190,997 | 3/1993 | Lindemann et al. . |
| 5,219,656 | 6/1993 | Klett et al. . |

*Primary Examiner*—Michael W. Ball
*Assistant Examiner*—Sam Chuan Yao
*Attorney, Agent, or Firm*—Banner & Allegretti, Ltd.

[57] ABSTRACT

A urea-formaldehyde resin modified with a water-insoluble anionic phosphate ester is used as binder in the preparation of glass fiber mats using a hydroxyethyl cellulose white water system. High tear strength glass fiber mats can be produced in a hydroxyethyl cellulose white water system using such a binder.

2 Claims, No Drawings

METHOD OF MAKING A HIGH TEAR STRENGTH GLASS MAT

This application is a division of application Ser. No. 08/123,094, filed Sep. 20, 1993, now U.S. Pat. No. 5,445,878.

BACKGROUND OF THE INVENTION

1. Field of the Invention

The invention relates to a modified urea-formaldehyde resin, to glass fiber mats using the modified urea-formaldehyde resin as binder, and a process of preparing the mats. In particular, the invention relates to a urea-formaldehyde resin modified with a water-insoluble anionic phosphate ester which is useful in the preparation of glass fiber mats formed using a hydroxyethyl cellulose-containing "white water" glass slurry. The glass fiber mats of the invention exhibit high tear strength, a property which is desirable for use in roofing products, such as asphalt shingles.

2. Background of the Invention

Glass fiber mats are finding increasing application in the building materials industry, as for example, in asphalt roofing shingles, replacing similar sheets traditionally made of wood or cellulose fibers.

Glass fiber mats usually are made commercially by a wet-laid process, which is carried out on modified paper or asbestos making machinery. Descriptions of the wet-laid process may be found in a number of U.S. patents, including U.S. Pat. Nos. 2,906,660, 3,012,929, 3,050,427, 3,103,461, 3,228,825, 3,760,458, 3,766,003, 3,838,995 and 3,905,067. In general, the known wet-laid process for making glass fiber mats comprises first forming an aqueous slurry of short-length glass fibers (referred to in the art as "white water") under agitation in a mixing tank, then feeding the slurry through a moving screen on which the fibers enmesh themselves into a fleshly prepared wet glass fiber mat, while water is separated therefrom.

Unlike natural fibers such as cellulose or asbestos, glass fibers do not disperse well in water. In an attempt to overcome this problem, it has been the practice in the industry to provide suspending aids for the glass fibers. Such suspending aids usually are materials which increase the viscosity of the medium so that the fibers can suspend themselves in the medium. Suitable dispersants conventionally employed in the art include polyacrylamide, hydroxyethyl cellulose, ethoxylated amines and amine oxides.

Other additives such as surfactants, lubricants and defoamers have conventionally been added to the white water. Such agents, for example, aid in the wettability and dispersion of the glass fibers and contribute to the strength of the wet glass fiber mat. U.S. Pat. No. 4,178,203 is directed to a method for improving the wet tensile strength of freshly prepared glass fiber mats so that they may be conveniently handled and transferred for further processing (e.g., applying binders and drying) to form the finished glass fiber mat product. In the disclosed process, anionic surfactants are added to the white water glass slurry.

In the manufacture of glass mat, a high degree of flexibility and tear strength is desired in addition to the primary dry tensile and hot wet tensile properties. A binder material is therefore used to hold the glass fiber mat together. The binder material is impregnated directly into the fibrous mat and set or cured to provide the desired integrity. The most widely used binder is urea-formaldehyde resin because it is inexpensive.

While urea-formaldehyde resins are commonly used to bond the glass fibers together to provide the strength properties of the glass mat, some urea-formaldehyde resin binders are too brittle to form glass mats useful in roofing shingles. Typically, the tensile strengths of mats bound with urea-formaldehyde deteriorate appreciably when the mats are subjected to wet conditions, such as the conditions normally encountered by roofing products. Tear strengths higher than those typically provided by urea-formaldehyde resins have been obtained by modifying the resin with cross-linkers and various catalyst systems or by fortifying the resin with a large amount of latex polymer, usually a polyvinyl acetate, vinyl acrylic or styrene-butadiene. Latex provides increased hot wet tensile strength and tear strength. The use of styrene-butadiene modified urea-formaldehyde resins as a binder for glass fiber mats is disclosed, for example, in U.S. Pat. Nos. 4,258,098 and 4,917,764.

U.S. Pat. No. 4,430,158 is directed to an improved binder composition for glass mats. The binder composition consists essentially of a urea-formaldehyde resin and a highly water soluble anionic surfactant that wets the surfaces of the glass fibers. Suitable surfactants have hydrophobic segments containing from 8 to 30 carbon atoms and anionic segments. Suitable anionic moieties include carboxy, sulfate ester, phosphate ester, sulfonic acid, and phosphoric acid groups. The surfactant also may contain a polyalkyleneoxy chain having up to 10 alkyleneoxy units. Glass mats produced from an amine oxide white water system and bound with the surfactant-containing resin, are described as retaining up to 79 percent of their dry tensile strength when subjected to severe wet conditions. No increase in tear strength is obtained by use of the urea-formaldehyde surfactant-containing resin. Cationic surfactants, non-ionic surfactants, and anionic surfactants which do not possess the required water solubility and ability to wet the sized glass fibers, are said to provide unsuitable mats which can retain a much smaller fraction of their dry tensile strength.

When the glass fibers are dispersed in white water containing a polyacrylamide viscosity modifier, high tear mat strengths have been achieved with latex fortification of urea-formaldehyde resins. However, when a hydroxyethyl cellulose viscosity modifier is used in the white water, the desired high tear strength properties are not achieved with latex fortification. As such, a need in the art exists for providing a modified urea-formaldehyde resin which can be used in a hydroxyethyl cellulose white water system.

SUMMARY OF THE INVENTION

The invention is directed to a modified urea-formaldehyde resin. The invention also is directed to a process for preparing glass fiber mats, and to glass fiber mats produced by the method. The mats are useful in, for example, the manufacture of roofing shingles.

This invention is based on the discovery that by adding a water-insoluble anionic phosphate ester to a urea-formaldehyde resin, high tear strength products can be prepared from mats formed using hydroxyethyl cellulose-containing white water.

In manufacturing glass fiber mats in accordance with the invention, glass fibers are slurried into an aqueous medium containing hydroxyethyl cellulose. This white water, i.e., the hydroxyethyl cellulose-containing slurry of glass fibers in water, then is dewatered on a foraminated surface to form a mat. The modified binder of the invention then is applied to the mat before it passes through a drying oven where the mat is dried and incorporated binder resin is cured. Glass fiber mats produced in accordance with the invention exhibit good dry and hot wet tensile strength and superior high tear strength.

One object of the invention is to provide a binder composition for use in making glass fiber mats comprising a urea-formaldehyde resin and a water-insoluble anionic phosphate ester.

Another object of the invention is to provide glass fiber mats comprising a urea-formaldehyde resin and a water-insoluble anionic phosphate ester.

Yet another object of the invention is to provide glass fiber mats prepared by dispersing glass fibers in an aqueous medium containing hydroxyethyl cellulose to form a slurry, passing the slurry through a mat forming screen to form a wet glass fiber mat, applying a binder comprising a urea-formaldehyde resin and a water-insoluble anionic phosphate ester to said wet glass fiber mat, and curing the binder.

DETAILED DESCRIPTION OF THE INVENTION

Urea-formaldehyde resins have been modified with cross-linkers and various catalyst systems or fortified with large amounts of latex to achieve high glass mat tear strengths in mats processed in polyacrylamide-containing white water. However, such modified and fortified resins have no effect in a hydroxyethyl cellulose-containing white water system. It has now been discovered that the modification of urea-formaldehyde resin with a water-insoluble anionic phosphate ester as a binder for glass mat obtained from a hydroxyethyl cellulose-containing white water system not only provides higher tear strength without a loss in dry or hot wet tensile properties, but also does not require latex fortification. This not only eliminates handling and clean up problems associated with latexes, but is also significantly lower in cost.

The process of forming a glass fiber mat in accordance with the invention begins with chopped bundles of glass fibers of suitable length and diameter. While reference is made using chopped bundles of glass fibers, other forms of glass fibers such as continuous strands may also-be used. Generally, fibers having a length of about ¼ inch to 3 inches and a diameter of about 3 to 20 microns are used. Each bundle may contain from about 20 to 300, or more, of such fibers.

The glass fiber bundles are added to the dispersant medium to form an aqueous slurry, know in the art as "white water." The white water typically contains about 0.5% glass. The dispersant used in the practice of the invention contains hydroxyethyl cellulose. The amount of hydroxyethyl cellulose used should be effective to provide the viscosity needed to suspend the glass particles in the white water. The viscosity is generally in the range of 5 to 20 cps, preferably 12 to 14 cps. An amount of from about 0.1 to about 0.5% solid hydroxyethyl cellulose in the water should be sufficient. The fiber/white water mixture generally is at a temperature of 65° to 95° F. to obtain preferred viscosity. The fiber slurry then is agitated to form a workable uniform dispersion of glass fiber having a suitable consistency. The dispersant may contain other conventional additives known in the art. These include surfactants, lubricants, defoamers and the like.

The fiber/white water dispersion then is passed to a mat-forming machine containing a mat forming screen. On mute to the screen, the dispersion usually is diluted with water to a lower fiber concentration. The fibers are collected at the screen in the form of a wet fiber mat and the excess water is removed by gravity or, more preferably, by vacuum in a conventional manner.

The binder composition of the invention then is applied to the gravity- or vacuum-assisted dewatered wet glass mat. Application of the binder composition may be accomplished by any conventional means, such as by soaking the mat in an excess of binder solution, or by coating the mat surface by means of a binder applicator.

The urea-formaldehyde resin used as binder in the invention is a urea-formaldehyde resin modified with an anionic phosphate ester. The anionic phosphate esters useful in the invention are water insoluble. Particularly preferred anionic phosphate esters are unneutralized water insoluble phosphate esters, such as the type exemplified by ZELEC UN® available from Du Pont. ZELEC UN® is an unneutralized, water-insoluble anionic phosphate ester with a high molecular weight a $C_8$ of $C_{16}$ fatty alcohol backbone. Stated another way, ZELEC UN® is an unneutralized water-insoluble, anionic phosphate $C_8$ of $C_{16}$ alkyl ester of phosphoric acid and a fatty alcohol. A urea-formaldehyde resin modified with ZELEC UN® has been found to be particularly advantageous in the preparation of glass fiber mats having high tear strength from hydroxyethyl cellulose white water.

Methods of preparing urea-formaldehyde resins which may be used to prepare the binder composition of the invention are known to those skilled in the art. Many urea-formaldehyde resins which may be used in the practice of the invention are commercially available. Urea-formaldehyde resins such as the types sold by Georgia Pacific Corp. for glass mat application and those sold by Borden Chemical Co., may be used. These resins generally are modified with methylol groups which upon curing form methylene or ether linkages. Such methylols may include N,N'-dimethylol, dihydroxymethylolethylene; N,N' bis-(methoxymethyl), N,N'-dimethylolpropylene; 5,5-dimethyl-N,N' dimethylolpropylene; N,N'-dimethylolethylene; and the like.

The binder composition is prepared by rapidly dispersing the anionic phosphate ester into the urea-formaldehyde resin having a pH of 7.5 to 8.5. If needed pH of the resin is adjusted to 7.5 to 8.5 with caustic. The amount of phosphate ester is about 0.1 to about 5.0%, preferably about 0.5% of the binder composition.

Urea-formaldehyde resins useful in the practice of the invention generally contain 45 to 65%, preferably, 50 to 60% non-volatiles, have a viscosity of 50 to 500 cps, preferably 150 to 300 cps, a pH of 7.0 to 9.0, preferably 7.5 to 8.5, a free formaldehyde level of 0.0 to 3.0%, preferably 0.1 to 0.5%, a mole ratio of formaldehyde to urea of 1.1:1 to 3.5:1, preferably 1.8:1 to 2.1:1, and a water dilutability of 1:1 to 100:1, preferably 10:1 to 50:1.

Whereas high tear strength mats can be prepared using latex-fortified binders when the white water additive is polyacrylamide, high strength mats have not heretofore been prepared using hydroxyethyl cellulose. In contrast to the polyacrylamide white water system, which has an anionic charge and has chemical attraction for a weak to strong cationic urea-formaldehyde resin, hydroxyethyl cellulose is a cationic viscosity modifier. While not wishing to be bound to a particular theory, it is believed that the addition of an anionic phosphate ester to the urea-formaldehyde resin acts to negate the cationic charge of hydroxyethyl cellulose that comes in contact with the resin on the glass fibers.

Following application of the binder, the glass fiber mat is dewatered under vacuum to remove excess binder solution. The mat then is dried and incorporated binder composition is cured in an oven at elevated temperatures, generally at a temperature of at least about 200° C., for a time sufficient to cure the resin. The amount of time needed to cure the resin is readily determinable by the skilled practitioner. Heat treatment alone is sufficient to effect curing. Alternatively, but less desirably, catalytic curing in the absence of heat may be used, such as is accomplished with an acid catalyst, e.g., ammonium chloride or p-toluene sulfonic acid.

The finished glass mat product generally contains between about 60% and 90% by weight glass fibers and between about 10% and 40% by weight of binder, 15–30% of binder being most preferable.

The following examples are intended to be illustrative only and do not limit the scope of the claimed invention.

EXAMPLE 1

Glass fiber mats were prepared by adding 0.5 gms of surfactant (Katapol VP-532), 0.1 gms of defoamer (Nalco 2343) and 6.5 gms of Manville 1" cut glass fibers obtained from Schuller International to 7.5 liters of hydroxyethyl cellulose-containing white water having a viscosity of 12 to 14 cps and mixed for 3 minutes. Excess water was drained and then vacuum dewatered on a foraminated surface to form a wet glass fiber mat. A urea-formaldehyde binder containing 22 to 25% solids was applied on the fiber mat and excess binder removed by vacuum. The mat was then placed in a Werner Mathis oven for 60 seconds at 205° C. to cure the resin.

EXAMPLE 2

A commercially available urea-formaldehyde resin (GP 2928) was used as a control resin. This control resin, GP 2928 resin fortified with 23% polyvinyl acetate (PVAc), and resin modified with 0.5% ZELEC UN® (GP 328T67) were used as binder to prepare glass fiber mats as described in Example 1.

Seven 3"×5" cut samples were tested for tensile strength under dry conditions and after soaking in an 85° C. water bath for 10 minutes on an Instron with a crosshead speed of 2 inches and a jaw span of 3 inches. Tear strength was tested on 2.5"×3.0" cut samples using an Elmendorf Tear Machine. The mean values of all tests are shown in Table I.

TABLE I

| Resins | Mat. Wt.[a] | % LOI | Dry Tensile[b] | Hot Wet Tensile[b] | % R | Tear[c] |
|---|---|---|---|---|---|---|
| GP 2928 | 1.80 | 24 | 117 | 81 | 69 | 390 |
| GP 2928 + 23% PVAc | 1.75 | 22 | 115 | 75 | 65 | 380 |
| GP 328T67 (+ 0.5% ZELEC UN ®) | 1.75 | 21 | 129 | 78 | 60 | 515 |

[a]pounds per hundred square feet
[b]pounds for a 3" wide sheet
[c]grams

Dry tensile strength, hot water tensile strength and percent retention (%R) of dry tensile strength under hot wet condition (hot wet/dry) of the urea-formaldehyde resin containing ZELEC UN® compare favorably to those of the control (urea-formaldehyde resin) and the latex fortified urea-formaldehyde resins. In contrast, the ZELEC UN® modified urea-formaldehyde resin produced a glass fiber mat having superior tear strength compared to the control urea-formaldehyde resin and the latex fortified urea-formaldehyde resin.

EXAMPLE 3 (COMPARISON)

Glass fiber mats were prepared as described in Example 1 except the hydroxyethyl cellulose white water system was replaced by a polyacrylamide white water system containing 0.02 to 0.1% polyacrylamide and having a viscosity of 4–10 cps, preferably 6 cps. A commercially available latex fortified urea formaldehyde resin (GP 2928 containing 23% PVAc), a commercially available urea-formaldehyde resin modified with a polyamine (GP 2942) and a urea formaldehyde resin containing 0.5% ZELEC UN® (GP 328T67) were used to cure the glass fiber mats as described in Example 2. Dry and hot wet tensile strength and tear strength was determined as described in Example 2. The results are show in Table II. The values shown in Table II are the ranges of the means of 5 studies, 7 samples per study.

TABLE II

| Resins | Mat. Wt. | % LOI | Dry Tensile | Hot Wet Tensile | % R | Tear |
|---|---|---|---|---|---|---|
| GP 2928 23% PVAc | 1.60–1.90 | 18–25 | 120–140 | 65–104 | 50–80 | 300–350 |
| GP 2942 (+ polyamine modifier) | 1.60–1.90 | 18–25 | 120–140 | 65–104 | 50–80 | 400–500 |
| GP 328T67 (+0.5% ZELEC UN ® ) | 1.60–1.90 | 18–25 | 120–140 | 65–104 | 50–80 | 300–350 |

EXAMPLE 4

Glass fiber mats prepared as described in the hydroxyethyl cellulose white water system of Example 1 were cured with the same resins used in Example 3 and tested for dry and hot wet tensile strength and tear strength as described in Example 2. The results (range mean values of 5 studies—7 samples per study) are shown in Table III.

TABLE III

| Resins | Mat. Wt. | % LOI | Dry Tensile | Hot Wet Tensile | % R | Tear |
|---|---|---|---|---|---|---|
| GP 2928 + 23% PVAc | 1.60–1.80 | 18–25 | 100–110 | 53–84 | 50–80 | 360–400 |
| GP 2942 (+ polyamine modifier) | 1.60–1.80 | 18–25 | 110–120 | 59–92 | 50–80 | 380–450 |
| GP 328T67 (+ 0.5% ZELEC UN ® ) | 1.60–1.80 | 19–25 | 120–130 | 63–100 | 50–90 | 500–600 |

The use of a phosphate ester modified-resin provided higher tear strength to glass mats prepared using a hydroxyethyl cellulose white water system. The high tear strength obtained in Examples 2 and 4 for glass mats prepared using the hydroxyethyl cellulose white water system could not be obtained using the polyacrylamide white water system of Example 3.

EXAMPLE 5

Glass fiber mats prepared as described in the hydroxyethyl cellulose white water system of Example 1 were cured with a commercially available latex fortified urea-formaldehyde resin (GP 2928 containing 25% PVAc), a urea-formaldehyde resin containing 0.5% ZELEC UN® (GP 328T67) or a urea-formaldehyde resin containing 0.5% ZELEC TY®. ZELEC TY® is a neutralized, water-soluble anionic phosphate ester with a lower molecular weight fatty alcohol backbone. The glass fiber mats were tested for dry and hot wet tensile strength and tear strength as described in Example 2. The mean values are shown in Table IV.

TABLE IV

| Resins | Dry Tensile | Hot Wet Tensile | % Retention | Tear Strength | Mat Wt. | % LOI |
|---|---|---|---|---|---|---|
| GP 2928 + 25% PVAc | 139 | 96 | 70 | 350 | 1.80 | 29 |
| GP 328T67 (+ ZELEC UN ® ) | 140 | 89 | 63 | 490 | 1.80 | 28 |
| GP 2928 (+ ZELEC TY ® ) | 141 | 104 | 74 | 300 | 1.90 | 28 |

As can be seen in Examples 2 and 4, resins modified with water-insoluble anionic phosphate esters, such as ZELEC UN®, provide significantly higher tear strength in glass mat than latex fortified urea-formaldehyde resins when the glass mat is formed using a hydroxyethyl cellulose white water system. Although use of the water-soluble ZELEC TY® modified binder gave dry and hot wet tensile strength equal to the latex fortified binder, the ZELEC TY® modified binder did not improve the tear strength properties compared to the latex fortified binder, as did the water-insoluble ZELEC UN® modified binder.

I claim:

1. A method of making a glass fiber mat comprising:

dispersing glass fibers in an aqueous medium containing hydroxyethyl cellulose to form a slurry, passing the slurry through a mat forming screen to form a wet glass fiber mat, applying a binder comprising a urea-formaldehyde resin and a water-insoluble, unneutralized anionic phosphate ester, a $C_8$ to $C_{16}$ fatty alcohol to said wet glass fiber mat, and curing the binder.

2. The method of claim 1 wherein the anionic phosphate ester is present in an amount of from about 0.1% to about 5.0% based on the weight of the binder.

* * * * *